US006244973B1

(12) United States Patent
Eichelberger

(10) Patent No.: US 6,244,973 B1
(45) Date of Patent: Jun. 12, 2001

(54) TARGET FOR SWINGING A GOLF CLUB

(76) Inventor: Kenneth C. Eichelberger, 4830 Seneca Park, Fremont, CA (US) 94538

( * ) Notice: Subject to any disclaimer, the term of this patent is extended or adjusted under 35 U.S.C. 154(b) by 0 days.

(21) Appl. No.: 09/277,411

(22) Filed: Mar. 26, 1999

(51) Int. Cl.[7] ..... A63B 69/36

(52) U.S. Cl. ..... 473/226; 473/235; 473/236; 273/DIG. 30

(58) Field of Search ..... 273/407, 408, 273/409, 410, 393, DIG. 30; 473/235, 236, 238, 219, 226, 231, 237; D21/302, 789, 790, 791

(56) References Cited

U.S. PATENT DOCUMENTS 1,464,029 * 8/1923 Coughtrie .
1,600,466 * 9/1926 Goldsworthy .
3,194,564 * 7/1965 Swan .
3,325,168 * 6/1967 Fyanes .
3,384,376 * 5/1968 Greenlee .
3,721,447 * 3/1973 Louderback .
4,054,288 * 10/1977 Perrine .
4,433,843 * 2/1984 Bricco .
4,470,603 * 9/1984 Myers .
4,969,645 * 11/1990 Barbador .
5,026,064 * 6/1991 Novosel .
5,082,284 * 1/1992 Reed .
5,782,701 * 6/1998 O'Bryan .

* cited by examiner

*Primary Examiner*—Sebastiano Passaniti
(74) *Attorney, Agent, or Firm*—Robert Samuel Smith

(57) ABSTRACT

A training device for developing a golfers swing based on a principle of driving a spike fixed to the sweet spot of a striking surface of a golf club, into the flat target surface of a slab of material selected to permit penetration and fixation of the spike in the target surface. The slab is preferably styrofoam and is supported by a stake inserted through the slab and into the ground. In an alternative arrangement, the slab is temporarily supported in its erect position by inserting its lower end in a slot in a pad.

10 Claims, 2 Drawing Sheets

TARGET FOR SWINGING A GOLF CLUB

FIELD OF THE INVENTION

This invention relates to training golfers and particularly to a golfer swinging a club against a target that registers where the club head strikes the target.

PRIOR ART AND INFORMATION DISCOSURE

Many golfers are almost fanatical about improving their golf scores. Consequently, many devices have appeared intended to help them improve the accuracy of driving the ball. these inventions generally comprise a target that the driver strikes with his club and the target sticks to the ball.

For example, U.S. Pat. No. 3,721,447 to Louderback describes a ball covered with Velcro™ loop material that adheres to the striking surface of a club covered with VELCRO hook material when the ball is struck by the club.

U.S. Pat. No. 5,026,064 to Novosel discloses a training head that, when the club is swung, strikes a moveable upright target composed of yieldable light weight material that becomes attached to the head. The addition of the target to the head provides increased resistance to train the player to increase head speed at impact and beyond. Emphasis on the training effect is to present "a relatively large target surface that the player strikes with the head of the training club thereby encouraging the player to relax due to the size of the target and the absence of any requirement other than to strike it." The surfaces of the target and club head are covered with Velcro™ in order to that the target stick to the club head.

U.S. Pat. No. 5,782,701 to O'Bryan discloses a golf practice aid comprising a deformable inner core and an outer energy absorbing cover that makes a sound and sticks bu hook and loop material to a striking surface when struck by the club head.

Two very important aspects regarding chiving a golf ball are:

(1.) The angle which the striking surface makes with the intended direction of the ball leaving the striking surface. Ideally, the striking surface should be perpendicular to the intended direction of travel;

(2) The proximity of the point of contact of the ball with the striking surface to a location on the striking surface known to golfers as the "sweetspot" The sweetspot is allocated at the center of the striking surface and the ability to cause the ball to meet the sweet spot is very important to distance and accuracy of the drive.

The ability to determine proximity of the point of contact to the sweet spot is not as accurate using the devices of the prior art as when using the present invention. Furthermore, none of the devices of the present invention give any indication of how close to perpendicular the striking surface is to the direction of travel of the ball.

SUMMARY OF THE INVENTION

It is an object of this invention to provide a device, used with a golf club, that helps a golfer improve his drive by displaying the the proximity of the sweet spot on his club to the target of this invention. It is another object that the device display the inclination of the striking surface to the direction of his swing. It is another object that the golfer using the device need not have to retrieve the device from any distance after striking the target.

This invention is directed toward a target being a slab of material, having a flat "target" surface such as a disk or rectangular block. A target pattern (bull's eye) is inscribed on the target surface. The material is preferably styrofoam. The invention also includes a spike, about an inch long with a flat head that is adhesively attachable to the striking golf club.

In one embodiment for outdoor use, a stake is positioned through the slab and stuck in the ground so that the target surface is stood erect. In another embodiment for indoor use, the invention includes a base pad laid on a ground or floor surface configured to detachably support the pad with the target surface upright.

In use, the golfer addresses with the target at his feet and in at location normally occupied by a golf ball. He swings the club and strikes the flat surface as if it were a golf ball thereby driving the spike into the styrofoam target. The target is impaled on the spike and carried through the rest of the stroke. The golfer is then able to observe where the spike entered the target in relation to the bulls eye and is thereby guided in correcting his swing. as indicated.

DESCRIPTION OF BEST MODES

Figure 1:
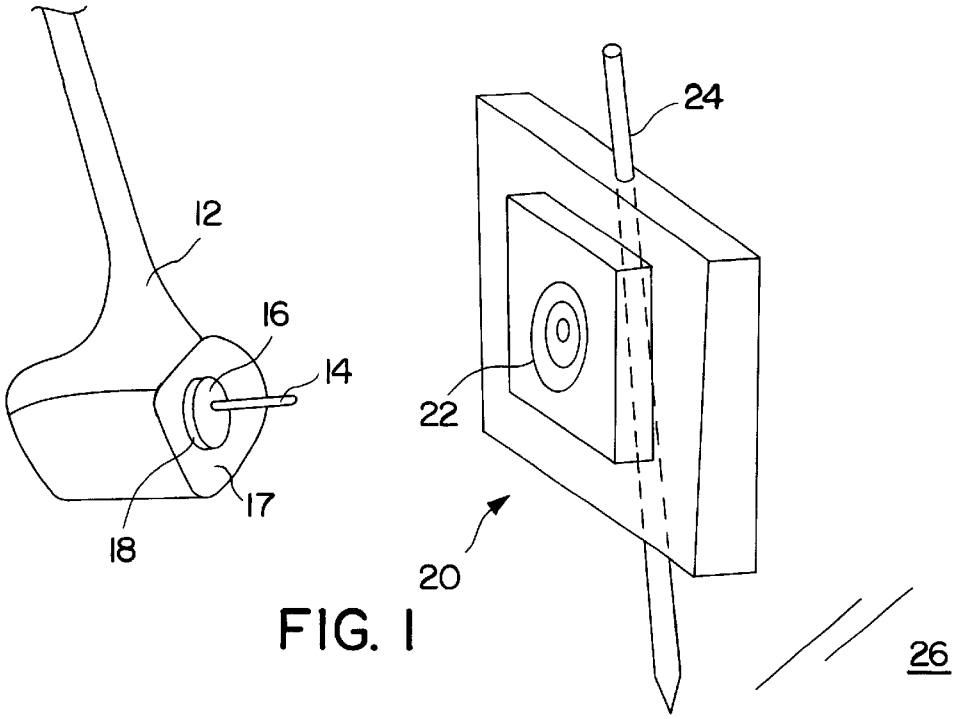
FIG. 1 is an assembly view of the invention.

Turning now to a discussion of the drawings, FIG. 1 shows an assembly view of the invention including a target 20 supported in an erect position by a stake 24 driven through the target 20 and into the ground 26. A one inch spike 14 has one end secured to one side of a broad head 16 which is attachable to the center (sweetspot) 16 of the striking surface 17 of a golf club 12. The head of the spike 14 is attachable to the striking surface by two sided adhesive tape 18. The tape 18 is peelable so that the club can also be used in the normal manner by peeling off the tape 18. There is also shown a target 20 being a rectangular slab of styrofoam having a target surface 22 with a target emblem facing the striking surface 17 of the club.

A stake 24 is shown inserted through the target 20 into the ground 26 to support the target 20 so that the target surface 22 is erect and facing a golfer (not shown) holding the club in a position to drive the spike 14 through the target surface 22 and impale the target 20 on the spike 14 as lie swings the club toward the target 20.

Figure 2:
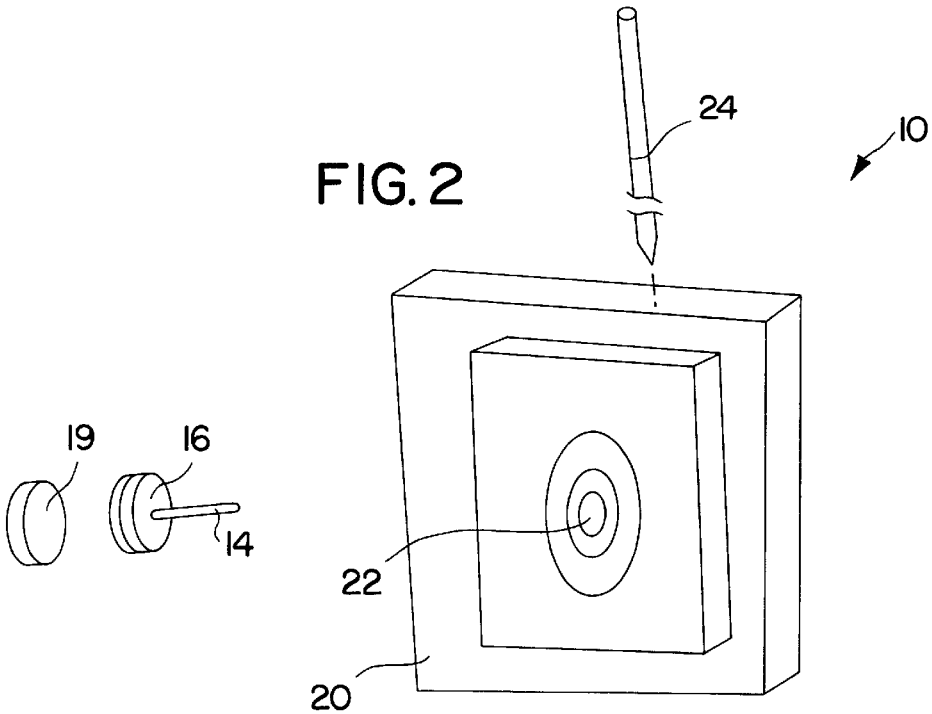
FIG. 2 is an exploded perspective view of the invention.

FIG. 2 is an exploded view showing the target 20, the stake 24, the ground 26, the spike 14, the head 16 of the spike 14, and the double sided adhesive patch 19

Figure 3:
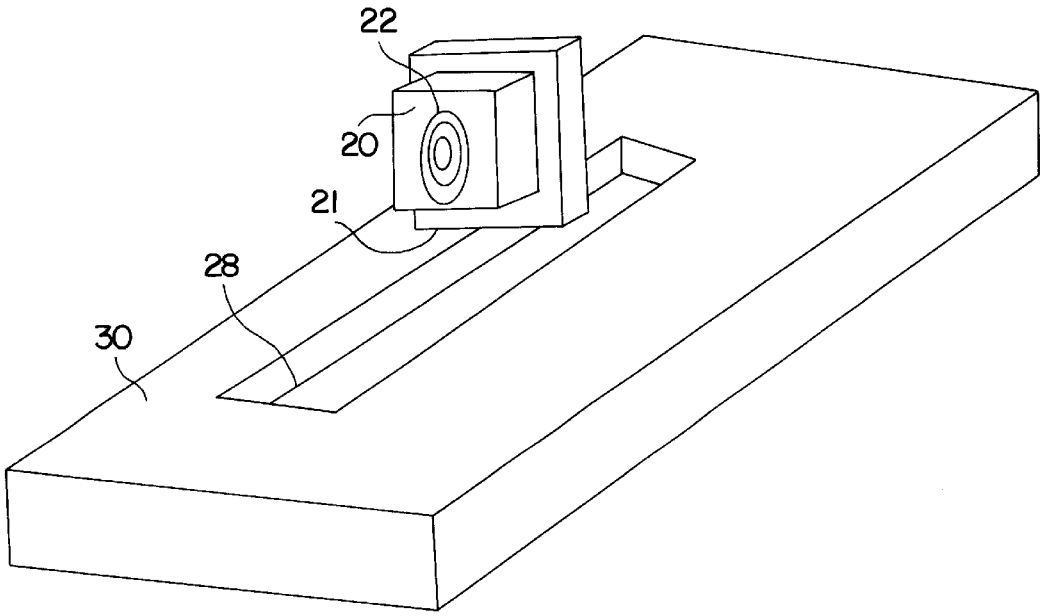
FIG. 3 shows an arrangement for supporting the target in a slot.

FIG. 3 shows an alternate embodiment in which the target 20 is releasably supported in an upright position by inserting a bottom edge 21 of the target 20 into a slot 28 in a flat horizontal base 30. The target is released from the slot 28 when the golfer swings the club with spike against the target surface 20.

In practice, the golfer addresses the target surface with his golf club as he would if the target surface were a golf ball. He swings the club head against the target surface so that the target becomes impaled on the face of the club. After finishing his swing, the golfer can examine the target stuck on the striking surface of the club and observe quantitatively two characteristics of his swing.

One characteristic is the accuracy with which he is able to drive the spike into the target surface. A second characteristic is the inclination of the striking surface with respect to the target surface.

There has been disclosed a training device for developing a golfers swing based on a principle of driving a spike fixed to the sweet spot of a striking surface of a golf club, into the flat target surface of a slab of material selected to permit penetration and fixation of the spike in the target surface. Application of this principle according to the invention is more effective than the cited art in terms of an ability to measure accuracy in making contact with the sweetspot of the striking surface and in terms of direction of the inclination of the striking surface relative to the intended direction of the swing.

Variations and modifications of the invention may be contemplated after reading the specification and studying the drawings which are within the scope of the invention.

For example, the target may be a disk or have another shape. The target material may be a porous paper or sponge composition rather than a foam of styrene.

Other arrangements may be used to support the target surface in a vertical orientation.

Figure 4:
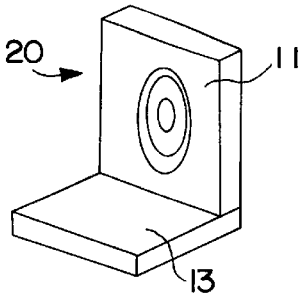
FIG. 4 shows another the device being an angle.

For example, FIG. 4 shows the device being an angle with one leg 11 having the target surface perpendicular to another leg 13 which is supported on the ground.

Figure 5:
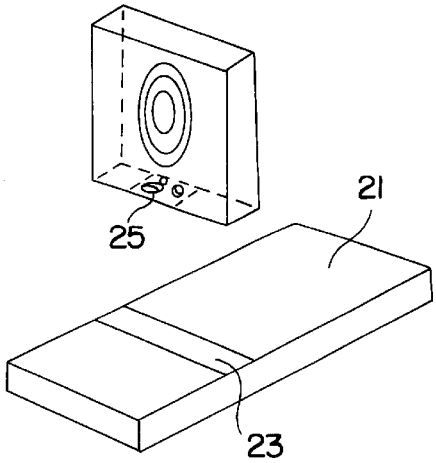
FIG. 5 shows the target attached to the base using velcro™.

As shown in FIG. 5, the base may be a flat board 21 with a patch 23 of VELCRO™ and the target 20 being the rigid plastic foam pad with a patch 25 of Velcro™ (hook/eye material) providing that the target is stuck to the base until driven apart by the club striking and impaling the target. The term "board" is understood to include a wood, metal or plastic panel.

I therefore wish to define the scope of my invention by the appended claims.

I claim:

1. A device for training a golfer using a golf club with a striking surface to develop accuracy in driving a golf ball which comprises:

a spike having one end attached to a head;

said head having one flat surface opposite another flat surface;

said spike extending perpendicularly away from said one flat surface;

adhesive means for detachably adhering said another flat surface to said striking surface;

a slab of material having a flat target surface;

a target emblem is imprinted on said target surface said slab being penetrable by said spike;

means for supporting said slab with said flat target surface vertical to permit said golfer to strike said target surface with said golf club and have said spike penetrate said target surface whereby said spike and said golfer is enabled to strike said target with said golf club to impale said slab on said spike at a location on said target surface that indicates accuracy in striking said target and is enabled to view the inclination of the striking surface with respect to the target surface providing said golfer to be trained develop accuracy in driving a golf ball.

2. The device of claim 1 wherein said material is a rigid plastic foam.

3. The device of claim 1 wherein said material is a rigid foam.

4. The device of claim 1 wherein said material is selected from a group of materials that consists of porous paper and sponge.

5. The device of claim 1 wherein said spike is about one inch long.

6. The device of claim 1 wherein said means for supporting said slab is a stake insertable through said slab in a direction parallel to said flat target surface enabling a user to stick an end of said stake into a base that is penetrable by said stake.

7. The device of claim 1 wherein said means for supporting said slab is a stake insertable through said slab in a direction parallel to said flat target surface enabling a user to stick an end of said stake into the ground.

8. The device of claim 1 wherein said slab comprises:

a block with said target surface being a surface of said block: and said means for supporting said block comprises:

a pad having one surface opposite another surface;

said one surface having a slot arranged in operable combination with said block permitting an end of said block to be positionable in said slot with said target surface perpendicular to said one surface and providing that said pad is positionable with said another surface supported on a support surface enabling a golfer to strike said target surface with said striking surface of said golf club.

9. The device of claim 1 wherein said adhesive means comprises double sided adhesive tape.

10. The device of claim 1 wherein said means for supporting said target comprises:

a board:

a patch of hook/eye material adhesively secured on said board;

a patch of hook/eye material adhesively secured on said target operably arranged to enable attaching said target to said board with said flat target surface positioned to permit striking said target surface with said club.

* * * * *